United States Patent [19]

Vinieratos et al.

[11] 3,952,527

[45] Apr. 27, 1976

[54] OFFSHORE PLATFORM FOR ARCTIC ENVIRONMENTS

[76] Inventors: Edward R. Vinieratos, Oxnard, Calif.; Robert E. Levien, Seattle; Frank W. Purdy, Lynnwood, both of Wash.

[22] Filed: Nov. 11, 1974

[21] Appl. No.: 522,776

Related U.S. Application Data

[63] Continuation of Ser. No. 313,862, Dec. 11, 1972, abandoned.

[52] U.S. Cl. ..... 61/46.5; 61/1 R; 62/259; 165/47

[51] Int. Cl.[2] ..... E02B 15/02; F24J 1/00; F25D 23/12

[58] Field of Search ..... 61/46.5, 46, 50, 1 R; 62/259, 260; 175/9; 165/47; 114/40, 42; 9/8 P

[56] References Cited

UNITED STATES PATENTS

| | | | |
|---|---|---|---|
| 3,488,967 | 1/1970 | Toossi | 61/46.5 |
| 3,645,104 | 2/1972 | Hogan | 61/46.5 |
| 3,740,956 | 6/1973 | Guy et al. | 61/46.5 |
| 3,831,385 | 8/1974 | Hudson et al. | 61/46.5 |

OTHER PUBLICATIONS

Oil and Gas Journal, Sept. 14, 1970, pp. 60–61.

*Primary Examiner*—Jacob Shapiro

[57] ABSTRACT

Offshore platform for resisting the pressure of external ice formations in which the base is generally frustoconical having upwardly and inwardly sloping surfaces. The upper part of the structure is an inverted cone frustum with upwardly and outwardly sloping surfaces to deflect the ice as it rides up and base. The waist surface is rounded. The interior of the platform is formed of vertical tubes which are filled with frozen hard material to assist the structure in resisting external forces.

15 Claims, 4 Drawing Figures

FRANK W. PURDY
ROBERT E. LEVIEN
INVENTOR.

BY Graybeal, Olds & Barnard
ATTORNEYS

FIG—3
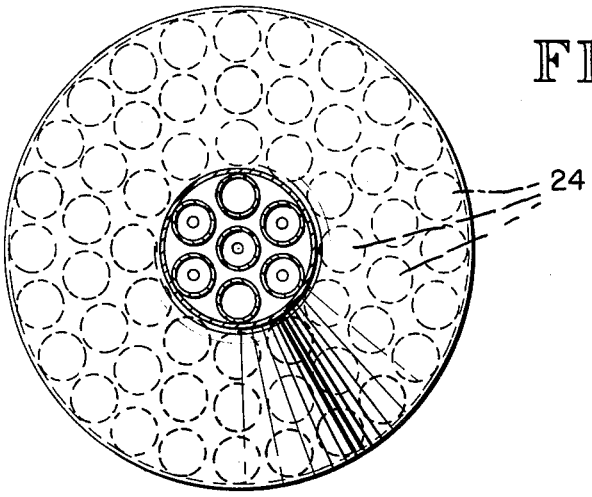
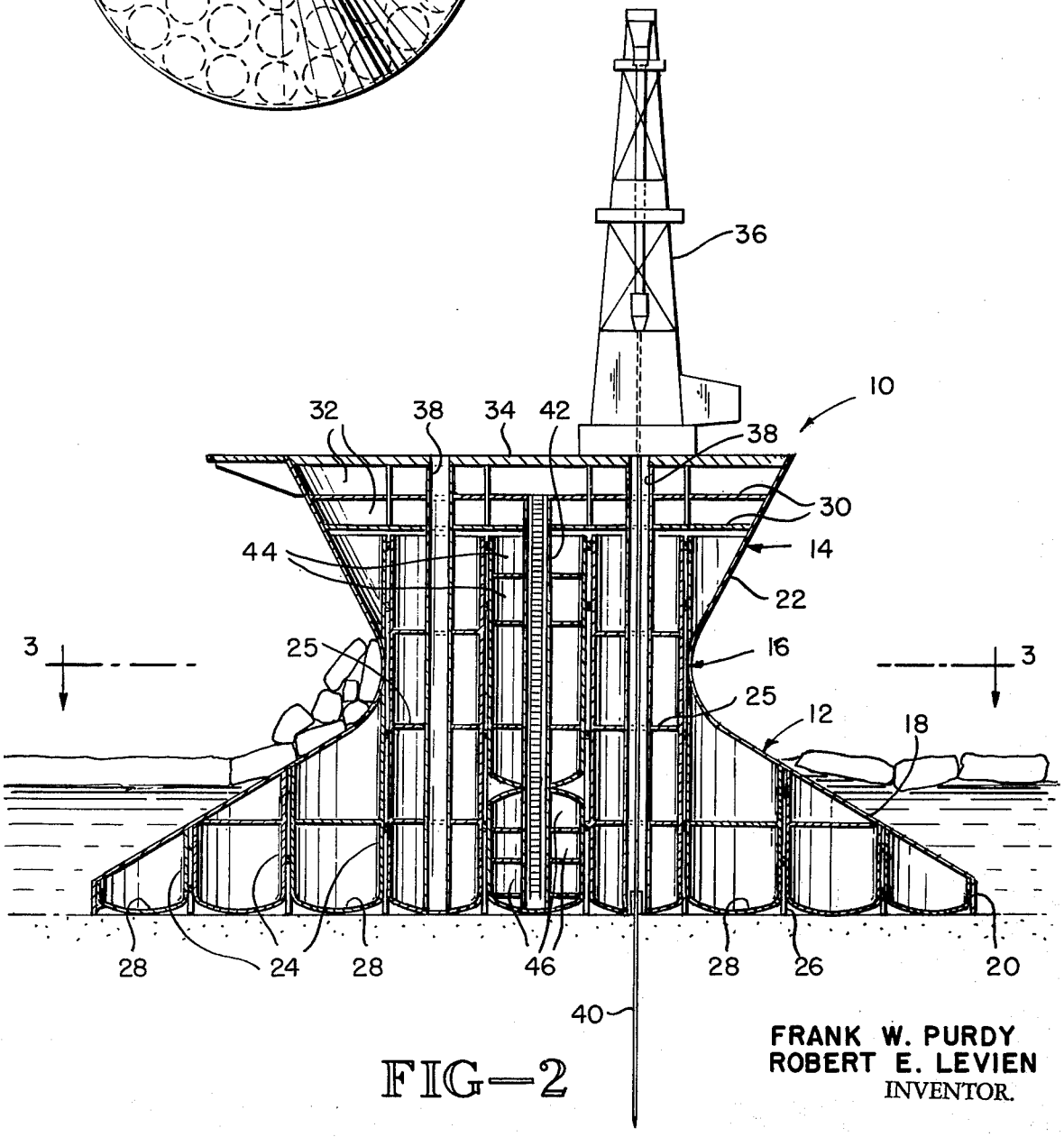
FIG—2
FRANK W. PURDY
ROBERT E. LEVIEN
INVENTOR.
BY
Graybeal, Cole & Barnard
ATTORNEYS

FRANK W. PURDY
ROBERT E. LEVIEN
INVENTOR.

BY
Graybeal, Cole & Barnard
ATTORNEYS

OFFSHORE PLATFORM FOR ARCTIC ENVIRONMENTS

This is a continuation of application Ser. No. 313,862, filed Dec. 11, 1972 and now abandoned.

CROSS REFERENCE TO RELATED APPLICATION

This application is related to co-pending U.S. Pat. application, Ser. No. 89,629 for "Offshore Platform for Arctic Environments" filed Nov. 16, 1970 and assigned to the assignee of the instant application.

BACKGROUND OF THE INVENTION

The invention relates generally to the art of offshore working platforms and more particularly to an offshore platform designed for use in Arctic environments where the platform must resist impinging ice.

Arctic and subArctic offshore areas are currently the focus of extensive surveying for oil and mineral resources. Sea ice is the major challenge to such offshore exploratory and recovery operations. However, many areas are sufficiently shallow to permit the use of appropriately designed platforms which would gain stability by resting on the bottom. Shallow offshore operational areas suitable for the location of frozen drilling platforms extend from the maritime coastlines of western Alaska and Canada, east to Baffin Bay and Davis Strait. Shallow lagoons, typically several miles long by a mile or two wide, separate the mainland from paralleling island chains. Lagoon ice rarely forms mid-winter floes as is the case in the sea, and, after summer breakup, the ice is "rotten" and has very little destructive capability.

Offshore of the islands, the sea gradually deepens to perhaps as much as 100 feet at 25 miles distance from the shoreline and accordingly sea ice conditions are encountered. The destructive capability of this ice is too severe for conventional offshore platforms with straight, vertical legs. Conventional platforms supported in this manner are in use as far north as Cook Inlet in Alaska. The tide-driven Cook Inlet ice fails by crushing as it impinges against platform legs. Colder and thicker Arctic ice in sheet form or floe is too strong for this failure mode alone and it is generally more desirable to induce failure by bending to take advantage of the relatively weak tensile strength of ice. Ice breaking ships employ this principle. Icebergs will penetrate the area in which the instant invention will be used, but, like ice islands, the frequency of occurrence is extremely small. In addition to this, their extreme draft will cause them to ground before reaching the shallower drilling sites. Blasting smaller bergs into several parts by explosive charges would eliminate any hazard they might present.

Annual and polar sheet ice, ridged and rafted ice, bergy bits, and movement of ice frozen fast to the drilling platform are major considerations in design. Ridged and rafted ice, and bergy bits present a relatively tall advancing front. Despite their concentrated mass, inherent weaknesses are caused by ice in block form, cracks and internal stresses. The mass below water level is warmed and weakened by the sea water heat source.

Annual ice usually forms off the north slope in late September. During the early stages of its growth, it is relatively thin and susceptable to break up into floes during storms. The impact of floes against one another or shore-fast ice creates pressure ridges and rafts. Sheet ice in the floes continues to thicken during the remainder of the winter to mid-May. However, the floes are usually unstable and may develop open leads or new ridges. By June, ice growth has terminated and weakening occurs until break up around mid-July. Depending upon winds, this rotten ice may or may not be present until freeze-up. During the growing season, annual ice floes are active 12 miles or so offshore. These floes in March through early May are strong in compression and have great impact momentum. Closer in-shore similar strength floes have less impact momentum, but are more liable to fuse themselves to structures before moving.

In the mid to late winter period when annual and polar sheet ice has high compressive strength, it is weaker in tensile or bending strength. This weakness can be used by forcing the ice to bend as it rides up on sloping sides designed into a structure. The most severe situation develops if ice in large sheet form becomes fused to external surfaces. Several methods of preventing or reducing the strength of such bonds have been considered. The most promising approaches are to discharge air or condenser sea water under the ice. Either of these measures will weaken sea ice in a contact area allowing it to move and thus promote failure in tension.

SUMMARY OF INVENTION

The invention relates to an offshore platform structure including an external shell supported by an internal framework and array of generally vertically disposed tubes. The tubes are compartmented to form chambers for controlled filling with sea water for submerging the structure at a use site and subsequent freezing of the water to create hard-fill backing for the external shell to resist external ice forces. The tubes are enclosed at their lower ends so that the frozen fill can be thawed and the water pumped out of the tube compartments to relocate the work site of the platform. The inverted frustoconical shape of the platform induces breaking up of the ice on the lower cone frustum section while the inverted cone frustum on top of the base section acts as a deflector. Pumping and refrigeration equipment are provided for handling filling and evacuation of the chambers as well as freezing and thawing the hard-fill material.

Accordingly, it is among the many features, advantages and objects of the invention, to use a frozen hard-fill material such as sea water, to add compressive strength to the base of an offshore platform. The interior of the structure is compartmented for controlled filling with sea water for submerging the structure at a use site and subsequent freezing to create hardfill backing for the shell to resist external ice impingement forces. The structure provides for pump rooms, mechanical equipment rooms, insulated housing, and work decks. The design enables economies in fabrication and rigging in lower latitude facilities because it can be towed from the construction site to its use location. The design has stable towing and emplacement characteristics, and the potential for later installation at other sites after a relatively simple thaw-float-resubmerge and refreeze cycle. The general principle of the invention may be utilized in the construction of causeway piers, dock and wharf supports and other offshore structures requiring strength for resisting ice floe forces.

BRIEF DESCRIPTION OF DRAWINGS

FIG. 2 is a cross-sectional elevation view illustrating additional details of the construction of the platform;

FIG. 3 is a plan cross-sectional view taken along the line 3—3 of FIG. 2 and further illustrating details of the construction.

DESCRIPTION OF PREFERRED EMBODIMENT

Figure 1:
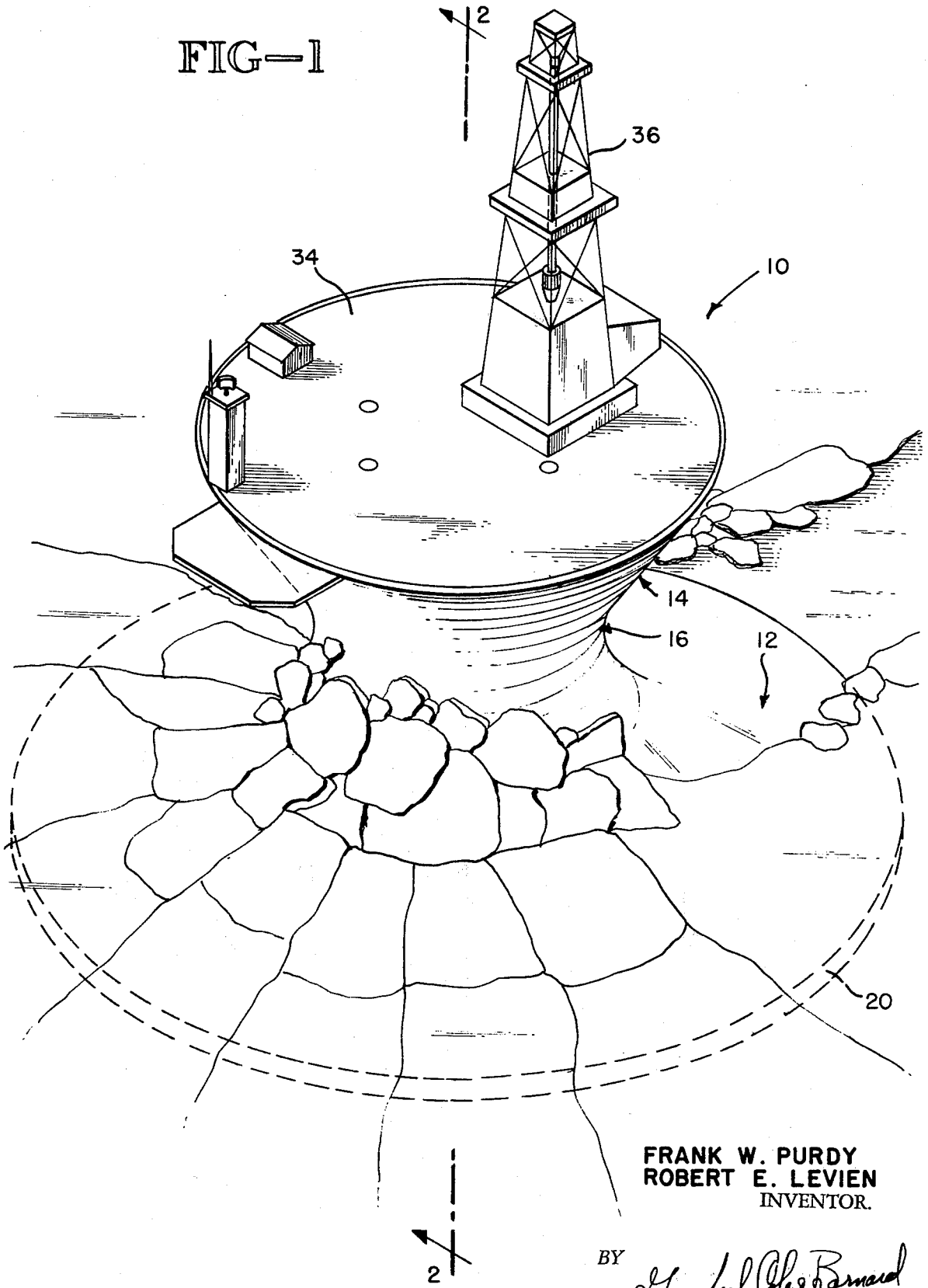
FIG. 1 is a perspective environmental view showing the platform in position and illustrating how the ice will break up on the impinging side and be swept around the structure.
Figure 4:
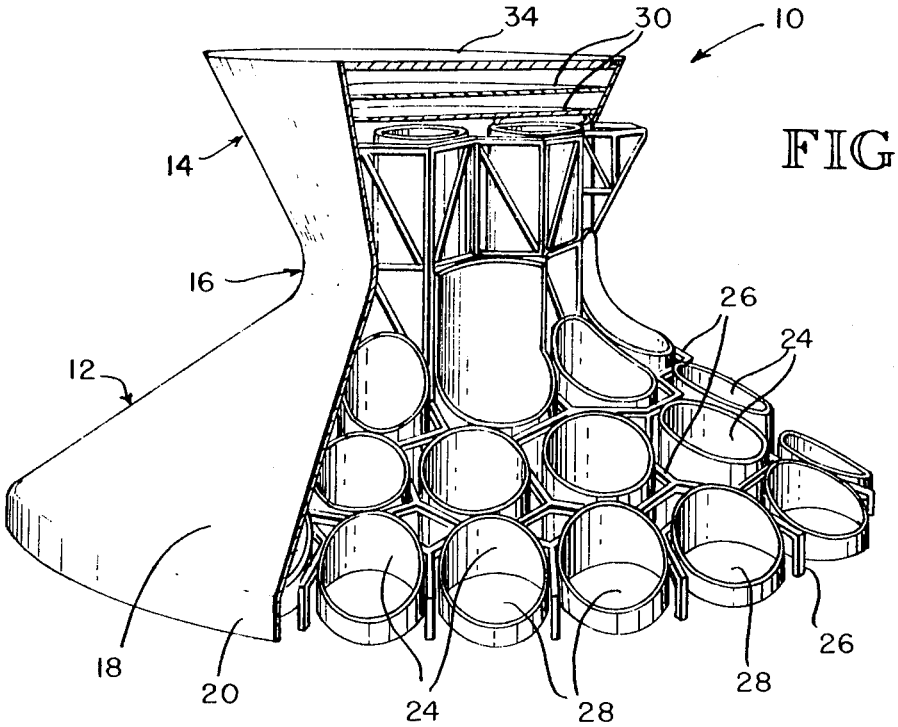
FIG. 4 is a perspective view with parts broken away to further illustrate details of construction of the platform.

Referring now to the drawings it will be seen that the platform, generally designated by the number 10, has a base section generally designated by the number 12, an upper section generally designated by the number 14 and a waist or neck section generally designated by the number 16. The base section 12 as can be seen has an upwardly and inwardly sloping surface 18, the angle of which may vary between about 30° to about 45° to the horizontal. A vertical wall section 20 is disposed around the periphery of the platform at the lower end thereof. Thus, it will be seen that the base portion 12 defines a cone frustum shape up to the reverse curve or waist section 16 which is generally arcuate in form. The waist forms a transition area between base section 12 and upper section 14. The upper section 14 can be seen to have an upwardly and outwardly extending surface 22. The upper section 14 defines an inverted cone frustum which together with the center of waist portions 16 acts as a deflector from the ice breaker surface 18 as the ice rides up surface 18. The external shell thus described is preferably fabricated from steel sheet and is supported from within by an internal array of tubes 24 which at their upper ends are formed, as shown in FIG. 4, to accommodate the external shell. Although the tubes are shown to be of a consistent diameter, it is recognized that diameters may vary, if desired. The tubes themselves are supported by framework 26 and have bottom walls 28. The tubes 24 will have horizontally disposed and spaced apart diaphragm walls 25 so that they can be compartmented for controlled filling with sea water for submerging the structure at a use site and subsequent freezing to create hard-fill backing for the shell to resist external ice impinging forces. It is also contemplated that the spaces between the tubes, defined by the supporting framework, will also be frozen.

The upper portion 14 of the structure will have at least one and probably two intermediate decks 30 defining heated and insulated living spaces 32 or spaces which will be used for a variety of purposes. A work platform or deck 34 will carry cranes, working equipment and other apparatus, such as drilling rigs 36, as desired. It will be seen that the tubes can be so designed that drillways 38 extend from work deck 34 down through the structure and terminate at the bottom to make way for a drill string 40. Additionally, an access shaft 42 will permit entrance to mechanical rooms 44 and to pump rooms 46.

The central tube, as shown, houses pump rooms near the bottom of the structure while other mechanical equipment rooms will be located just below the insulated housing and work decks. Tubes adjacent to the center provide drillways 38 for sea floor access columns when the platform is rigged for drilling. The shape of the platform base section 12 imposes maximum tensile stresses at the weaker bottom surface of an ice sheet. It induces radial and circumferential cracks in the impinging ice sheet so that the ice is broken into blocks or chunks. As the blocks are pushed up, they fall away laterally and are swept away by ice flowing around the structure. While it is contemplated that the shell surfaces will be steel plate, nevertheless reinforced and prestressed concrete shell structure could also be used.

Fill materials considered include gravel, mined sea ice, a frozen mixture of dredge silt and sea water, or 100% sea water. Gravel is undesirable both from the standpoint of availability and excessive compressibility which would allow shell deflection under external ice loads. Mined sea ice has the advantages of reducing the refrigeration required to achieve a solid frozen fill. However, availability becomes a problem because the structure is floated to a site when the sea is open and ice would have to be transported over some distance in addition to requiring specialized equipment for mining and crushing large volumes of ice. A silt-sea water mixture is more readily available, but stratification during settling in compartments or even the development of ice lenses while freezing would result in voids or discontinuities in the fill which make its load bearing characteristics unpredictable. Extracting such a fill would also be more difficult and time consuming than pumping sea water alone. Thus sea water alone becomes the most attractive fill material. Floating operations are performed rapidly and are easily controlled through headers. The additional refrigeration required is still less expensive than special equipment for handling other materials. Freezing creates a uniform fill material with proper flushing of brine concentrates, and by simply reversing the process, it can be discharged to refloat and relocate the platform.

When the structure is emptied of ice or water, it becomes a marine vessel with mobility, sea-keeping and, at its destination, sinking characteristics which play an important role in attaining efficient and practical performance. The upright vessel without ballast, but fully equipped and rigged for drilling, would draw less than about 10 feet of water. The structure because of the size and shape would have virtually no tendency to roll or pitch in a sea way. In long waves which approach the sides of the platform it would tend to follow the wave contour and remain normal to the wave surface. Smaller waves impinging on the hull would dissipate their energy in two ways, by breaking up and deflecting against the sloping surface of the structure, and by buffeting against the vertical sides and under surfaces of the hull. Strength to withstand wave action is an inherent part of the design.

Except for random shoals, ice scouring and glacial deposits, the Arctic offshore environs are quite flat and thus almost ideal for acceptance of the platform base. Silt, sand, and pebbles are the principal sea floor materials. Settling of the base into these sediments will not be severe. Thus, site preparations can be virtually eliminated by avoiding the sea floor irregularities occasionally encountered. The vertical ballast compartments 46 are designed to provide stability during submergence to depths of up to 70 feet. By selectively filling the compartment of tubes 46, loss of stability is held to a minimum and the structure remains stable throughout submergence. To flood the chambers, sea water is pumped from a common chamber which is replenished by a number of inlets radiating to sea chests in the exterior shell about 8 feet above the bottom. Auxiliary sea chests, located adjacent the pump chambers serve as intakes when the draft is less than 8 feet. Pumps will discharge to a closed loop header, with excess water being returned to the suction chamber through pressure compensated bypass valves for normal operation. For load demand pumps may be cut in or out as desired.

Relocation of the platform is accomplished by thawing the frozen fill, emptying the internal compartments, and towing to a new site. Environmental heating systems will be used to heat the secondary refrigerant. It is estimated that thawing will require less than two weeks. Discharging the fill involves venting and draining each compartment to the suction chamber by gravity where it is pumped overboard. Controls for the pumping system are located at a control point in an upper deck. Valving at the pump station is motorized and both valves and pumps are remotely controlled. Instrumentation is provided on a visual display control console to indicate flow rate, volume in compartments, pressures, attitude of the floating structure, and other necessary data. During freezing, brine that is rejected as the water freezes is free to settle. Concentration of brine will be reduced by pumping fresh sea water through the unfrozen part of each compartment, displacing the concentrated brine to an overboard discharge. It will be appreciated that the ice-filled structure will resist extremely great horizontal loads before moving. If poor soil is encountered on the offshore floor, the safety factor will be maintained as the base is frozen to the soil. When the ice is moving, it will exert a downward force component which will increase the resistance to moving of the platform. Also, if the base becomes frozen solidly to permafrost, the resistance to horizontal loads will be increased manyfold.

What is claimed is:

1. A movable offshore structure for resisting external ice forces and for supporting working platforms and the like comprising:

a. a generally side-enclosed external shell defined by a lower base position with an upwardly and inwardly angling surface and an upper supporting section with an upwardly and outwardly extending surface, said upper and lower sections together defining a waist deflector area, said offshore structure being substantially closed on the bottom so as to be made bouyant and floatable, b. a plurality of compartments within said shell, each capable of being independently filled with and emptied of freezable fill material, so that when said compartments are filled the structure will rest on the ocean floor and when empty the structure will be floatable and movable, said compartments being supported relative to one another by an internal supporting framework, c. refrigeration means for freezing said fill material, and d. at least one working deck located generally on top of said shell and said compartments for supporting work equipment and the like.

2. The offshore structure according to claim 1 and wherein said structure is designed so that when filled and resting on the ocean floor the water surface will be generally below the waist deflector area.

3. The offshore structure according to claim 1 and wherein said compartments will extend to above water level within said shell.

4. The offshore structure according to claim 1 and wherein said compartments and framework occupy substantially all of the base and waist portions and a substantial part of the upper supporting section.

5. The offshore structure according to claim 1 and wherein the angle of the upwardly and inwardly extending surface of the base portion is from about 20° to about 60° from the horizontal.

6. The offshore structure according to claim 1 and wherein at least one drillway shaft extends from the top to the bottom of said structure to permit drilling operations from said working platform into the ocean floor.

7. An offshore structure for resisting external ice forces and for supporting working platforms and the like comprising:

a. a continuous external shell generally circular in horizontal cross-sectional configuration and externally defined by a lower base portion of generally frusto-conical shape with an upwardly and inwardly extending surface and an upper supporting section with an upwardly and outwardly extending surface, said upper and lower sections together defining a waist deflector area therebetween, b. a plurality of generally watertight compartments within said shell, each capable of being independently filled with and emptied of freezable fill material, said compartments being closed and arranged so that the bottom of said structure is substantially closed, said compartments being supported relative to one another by an internal supporting framework, c. refrigeration means for freezing said fill material, and d. at least one working deck located generally on top of said shell and said tubes for supporting work equipment and the like.

8. The offshore structure according to claim 7 and wherein at least some of said compartments are defined by generally horizontally disposed and spaced apart dividing walls.

9. The offshore structure according to claim 8 and wherein said compartments and framework occupy substantially all of the base and waist portions and a substantial part of the upper supporting section.

10. The offshore structure according to claim 7 and wherein the angle of the upwardly and inwardly extending surface of the base portion is from about 20° to about 60° from the horizontal.

11. The offshore structure according to claim 7 and wherein at least one open drillway shaft extends from the top to the bottom of said structure to permit drilling operations from said working platform into the ocean floor.

12. An offshore structure for resisting external ice forces and for supporting platforms and the like, comprising:

a. a side-enclosed base structure comprising walls having top and bottom ends and in which the walls of said structure slope generally inwardly and upwardly from said bottom end to said top end, said bottom end being adapted to extend from below the ice level and said top end being adapted to extend above the water and ice levels;

b. frozen hard fill material substantially filling the interior of said base structure to add compressive strength and stability to said structure against external forces bearing thereagainst; and c. heat transfer means within the interior of said base structure for removing heat from and maintaining said frozen hard fill material in its frozen state.

13. The offshore structure according to claim 12 and wherein said heat transfer means for removing heat comprises an artificial refrigeration system.

14. The offshore structure according to claim 13 and wherein said bottom end of said base structure extends to the watter floor.

15. The offshore structure according to claim 14 and wherein said upper end of said structure is provided with cover means to cover said frozen hard fill material and minimize the transfer of heat into said hard fill material.

* * * * *